US007717058B2

(12) United States Patent
Beck et al.

(10) Patent No.: US 7,717,058 B2
(45) Date of Patent: May 18, 2010

(54) METHOD OF PREPARING TURBINE BLADES FOR SPRAY COATING AND MOUNTING FOR FIXING SUCH A TURBINE BLADE

(75) Inventors: Thomas Beck, Panketal (DE); Francis-Jurjen Ladru, Berlin (DE); Benjamin Lippke, Falkensee (DE); Marcus Mensing, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 848 days.

(21) Appl. No.: 11/518,554

(22) Filed: Sep. 8, 2006

(65) Prior Publication Data

US 2007/0110910 A1 May 17, 2007

(51) Int. Cl.
*B05C 21/00* (2006.01)

(52) U.S. Cl. ..... 118/504; 118/505; 118/721

(58) Field of Classification Search ..... 118/724, 118/504, 505, 721
See application file for complete search history.

(56) References Cited

U.S. PATENT DOCUMENTS

| | | | | |
|---|---|---|---|---|
| 4,271,005 A | | 6/1981 | Wright et al. | |
| 5,665,217 A | | 9/1997 | Gruver et al. | |
| 5,867,762 A | * | 2/1999 | Rafferty et al. | 428/548 |
| 6,485,655 B1 | | 11/2002 | Das et al. | |
| 6,863,927 B2 | * | 3/2005 | Langley et al. | 427/252 |
| 2001/0008323 A1 | * | 7/2001 | Reed et al. | 264/267 |

FOREIGN PATENT DOCUMENTS

| | | |
|---|---|---|
| DE | 698 15 644 T2 | 6/1999 |
| EP | 1 388 592 A1 | 2/2004 |
| EP | 1 537 950 A1 | 6/2005 |

* cited by examiner

*Primary Examiner*—Laura Edwards

(57) ABSTRACT

The invention relates to a method of preparing turbine blades for spray coating their blade region that is subjected to the medium flowing through during operation in a spray coating apparatus, in which the turbine blade is inserted with its blade root into a cavity of a mounting in such a way that it protrudes with the blade region that adjoins the blade root from an opening of the cavity to form a gap between the rim of the opening and the turbine blade, and in which the gap is bridged by a shielding fixed on the mounting, which is characterized in that a shielding layer of a plastic which is resistant during the spray coating is used for the shielding, the shielding layer being arranged in such a way that it reaches up to the boundary between the blade root and the blade region.

10 Claims, 2 Drawing Sheets

METHOD OF PREPARING TURBINE BLADES FOR SPRAY COATING AND MOUNTING FOR FIXING SUCH A TURBINE BLADE

CROSS REFERENCE TO RELATED APPLICATIONS

This application claims the benefits of European Patent application No. 05019698.9 filed Sep. 9, 2005 and is incorporated by reference herein in its entirety.

FIELD OF THE INVENTION

The invention relates to a method of preparing turbine blades for spray coating their blade region that is subjected to the medium flowing through during operation in a spray coating apparatus, in which the turbine blade is inserted with its blade root into a cavity of a mounting in such a way that it protrudes with the blade region that adjoins the blade root from an opening of the cavity to form a gap between the rim of the opening and the turbine blade, and in which the gap is bridged by a shielding fixed on the mounting. The invention also relates to a mounting for fixing a turbine blade in a spray coating apparatus, with at least one cavity having an opening for receiving the turbine blade in such a way that the turbine blade is inserted with a blade root into the cavity and protrudes with the blade region that adjoins the blade root and is subjected to the medium flowing through during operation from the opening of the cavity to form a gap between the rim of the opening and the turbine blade, a shielding being provided in the region of the opening to bridge the gap.

BACKGROUND OF THE INVENTION

Highly loaded workpieces, such as for example turbine blades intended for turbines, in particular gas turbines, such as moving and stationary blades, are coated to improve their temperature resistance and/or abrasion resistance with metals, metal alloys or ceramics suitable for the purpose. The coating takes place by means of a spray coating apparatus, in which the turbine blade is spray-coated. Examples of spray coating methods are atmospheric plasma spraying (APS) and high velocity oxygen fuel spraying (HVOF).

In the case of turbine blades, only those surfaces that are exposed to the medium flowing through—in the case of a gas turbine hot gas—are coated, while the blade root—root body or root plate—is covered by a mounting for fixing the turbine blade during the coating operation. For this purpose, the mounting has a cavity with an opening into which the turbine blade is inserted with its blade root, so that it protrudes with the portion of the blade that is to be coated from the opening of the cavity. The cavity may additionally have a connection to a compressed air source, from which compressed air can be blown into the cavity for cooling during the coating operation.

After the turbine blade is inserted into the cavity of the mounting, a gap remains between the inner side of the mounting and the turbine blade. This gap is filled by a shielding in the form of shielding plates. In order to avoid bridging of the coating material between the turbine blade and the shielding plates and resultant flaking off of coating material from the turbine blade when it is removed from the mounting, said plates are inserted in clamping devices in such a way that they protrude from the opening while forming a stepped transition from the turbine blade to the mounting. However, it must be accepted here that regions of the workpiece that protrude from the mounting and according to the specification must remain free of coating because they have already been mechanically brought to their final dimensions are spray-coated. This so-called "overspray" must therefore be ground away after the spray coating in a subsequent operation (overspray grinding). This additional method step is time-consuming and costly.

DE 698 15 644 T2 discloses a spray coating apparatus with a mounting into which a multiplicity of turbine blades can be inserted. Since only the tips of the turbine blades are to be coated, the blade region is provided with a plate covering which leaves only the tip of the blade exposed. The turbine blade is held by means of a block of an elastic material, which closely surrounds a part of the blade region that is adjacent the blade root in such a way that a compressive force is exerted for the purpose of fixing the shielding plate. The block is secured within the cavity of the mounting. In DE 698 15 644, reference is also made to the use of aluminum foil tape for the purpose of covering blade regions. The mounting for the spray coating apparatus described above is not suitable for coating the entire surface area of the blade region of a turbine blade, since a considerable part of the blade region is covered by the mounting itself.

SUMMARY OF THE INVENTION

The invention is based on the object of devising a method of the type stated at the beginning and a mounting suitable for it in such a way that the overspraying of parts of the turbine blades that according to the specification are to remain uncoated is avoided.

As far as the method is concerned, the object is achieved according to the invention by using for the shielding a shielding layer of a plastic which is resistant during the spray coating, the shielding layer being arranged in such a way that it reaches up to the boundary between the blade root and the blade region. The basic concept of the invention is therefore to provide a temperature-resistant plastic material between the turbine blade and the opening of the mounting, to be precise in such a way that the part of the turbine blade that is not to be coated is completely covered, that is to say only the turbine surface areas remain free. In this way, overspraying of parts of the workpiece that are to remain uncoated is avoided, and it is possible to dispense with subsequent grinding (overspray grinding). Use of the plastic material means that there is no adhesive attachment, or at most limited adhesive attachment, of the material that is used for the spray coating, so that flaking off of coating material when the turbine blade is removed from the mounting is avoided.

In a first alternative of the method according to the invention, the shielding is formed by the shielding layer alone, i.e. shielding plates are not used in the case of this embodiment. In a second alternative, the shielding is formed by using at least one shielding plate, to which the shielding layer is applied on the workpiece side. In both cases, a flexible shielding tape may be used for the shielding layer.

In the case where shielding plates are used, the shielding tape may be fastened to the shielding plate or plates, to be precise preferably in such a way that the shielding tape projects beyond the shielding plate or plates, in order that a stepped transition is to this extent also created. As an alternative to this, there is the possibility of the shielding layer being sprayed onto the shielding plate and then forming a coating.

Plastics which are temperature-resistant, so that they are resistant during the spray coating, and which are anti-adhesive, so that during the spray coating adhesive attachment of the coating material used thereby to the shielding layer does not occur, should be used as the material for the shielding layer. Plastics such as PTFE are suitable for this, for example. They avoid flaking off during removal after the coating operation. However, other plastic materials can also be used, provided that they are similarly or equally temperature-resistant and anti-adhesive to PTFE.

It is particularly expedient if the shielding layer is brought to bear against the turbine blade. This not only avoids overspraying of regions that are not to be coated, but also has advantageous effects on the cooling of the turbine blade, since the cooling air that is fed in is used better on account of the sealing effect of the plastic material.

The shielding should be arranged in such a way that it projects beyond the opening of the mounting. The shielding may be clamped onto the mounting in a way similar to the insert plates previously used.

As far as the object relating to the mounting is concerned, it is achieved according to the invention by a shielding layer of a plastic which is resistant during the spray coating being provided for the shielding, the shielding layer being arranged in such a way that, with the turbine blade inserted, it reaches up to the boundary between the blade root and the blade region.

The invention also relates to a spray coating apparatus for the spray coating of workpieces, the mounting being formed as described above.

BRIEF DESCRIPTION OF THE DRAWINGS

The invention is illustrated in more detail on the basis of exemplary embodiments in the drawing, in which.

DETAILED DESCRIPTION OF THE INVENTION

Figure 1:
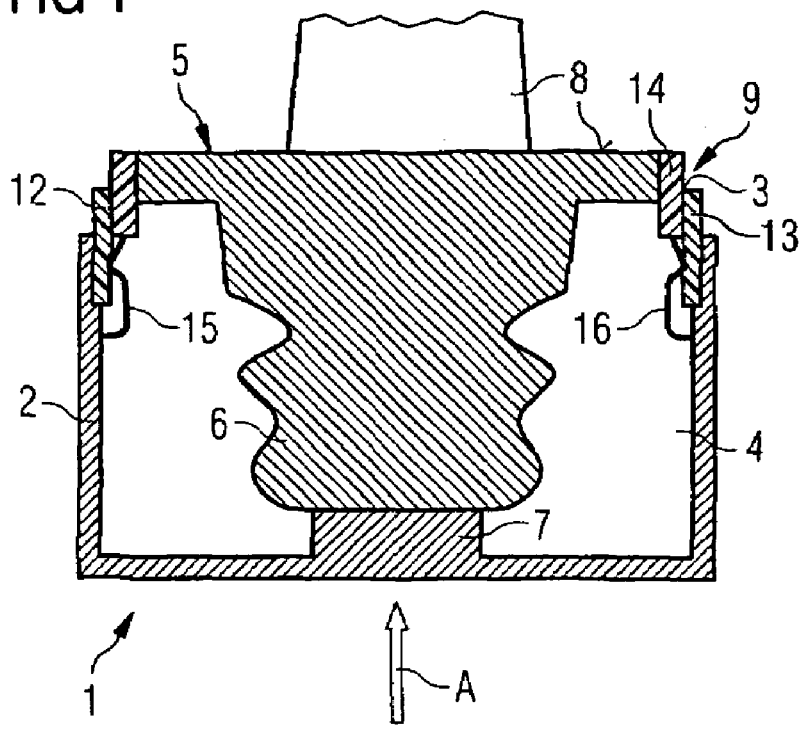
FIG. 1 shows a first exemplary embodiment of the mounting according to the invention with a turbine blade in vertical section.
Figure 2:
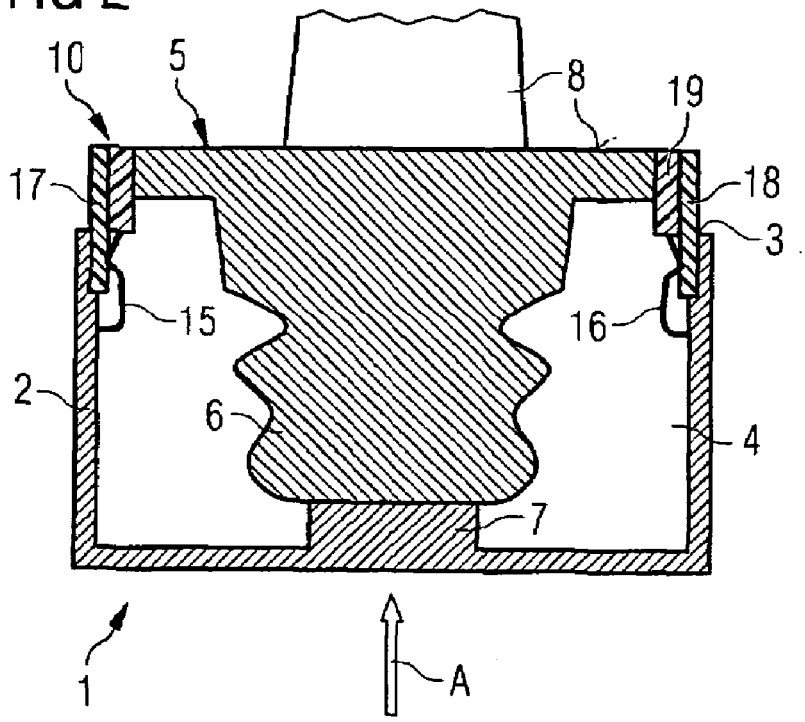
FIG. 2 shows a second exemplary embodiment of the mounting according to the invention in vertical section and FIG. 3 shows a third exemplary embodiment of the mounting according to the invention in vertical section.
Figure 3:
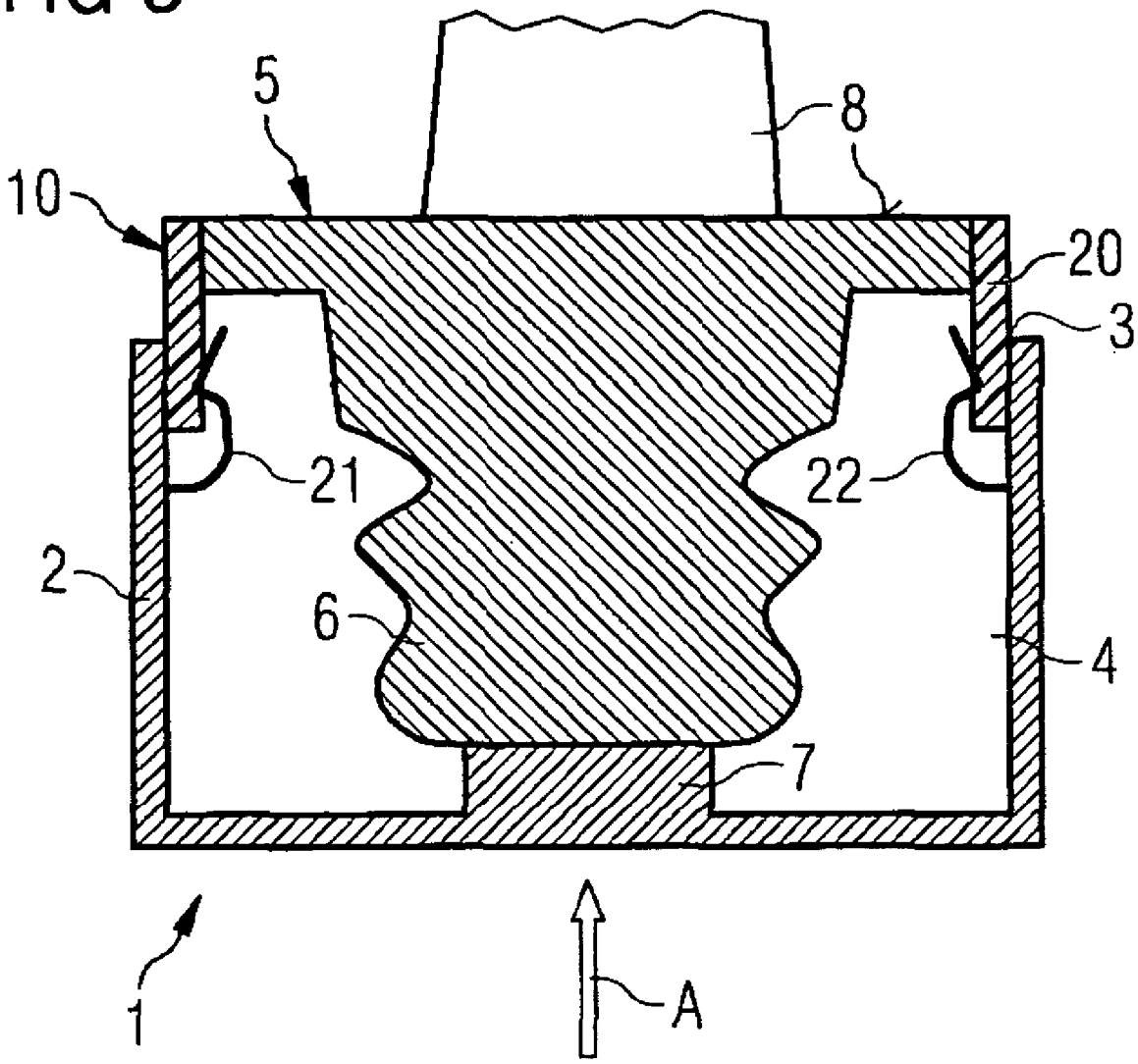

The mountings 1 represented in FIGS. 1 to 3 have in each case a pot-like hollow body 2, which has on the upper side an opening bounded by a rim 3 of the opening. The hollow body 2 encloses a cavity 4, into which a turbine blade 5 is inserted vertically from above in such a way that its blade root 6 is located substantially within the cavity 4 and rests there at the end face on a base 7, while the turbine blade 5 extends with its blade region 8 that is subjected to the medium flowing through during the operation of the turbine provided with it outside the mounting 1. Said region is represented in a shortened form. It is indicated by the arrow A that the turbine blade 5 is cooled with compressed air during the coating operation.

The mounting 1 is intended for being inserted into a spray coating apparatus, in order that the blade region 8—also including the upper side of the blade root 6—is provided there with a metal coating, which is applied by means of plasma spraying. In order that the coating remains restricted to said region, and that parts of the blade root 6 are not also coated, the mountings 1 have shieldings 9, 10, 11, which enclose the blade root 6 and shield the part of the blade root 6 that is protruding from the hollow body 2 in such a way that the coating remains restricted to the blade region 8. In this case, the shieldings 9, 10, 11 are differently formed.

In the case of the exemplary embodiment according to FIG. 1, the shielding 9 comprises shielding plates 12, 13 and a shielding tape 14 fastened to the inner side of the shielding plates 12, 13. The shielding plates 12, 13 are securely clamped on the inner side of the hollow body 2 by means of clamps 15, 16. The shielding tape 14 projects upward beyond the shielding plates 12, 13 to such an extent that it reaches up to the upper edge of the blade root 6 and bears against the side faces of the latter located there. In this way, the distance between the blade root 6 and the inner side of the hollow body 2 is bridged. At the same time, parts of the blade root 6 beneath its upper edge are prevented from being oversprayed during the coating.

In the case of the exemplary embodiment according to FIG. 2, the shielding 10 likewise has shielding plates 17, 18, which are provided on the inner side with a shielding tape 19. The arrangement of the shielding tape 19 is the same as in the case of the exemplary embodiment according to FIG. 1. The only difference is that the shielding plates 17, 18 extend upward to such an extent that their upper end faces lie flush with the upper end faces of the shielding tape 19.

In the case of the exemplary embodiment according to FIG. 3, no shielding plates are provided. The gap between the hollow body 2 and the turbine blade 5 is bridged here just by a shielding tape 20, which in the lower region bears against the inner side of the hollow body 2 and is securely clamped there by means of clamps 21, 22 and which in the upper region bears against the outer side of the blade root 6. Here, too, the shielding tape 20 covers the blade root 6 up to its upper edge, so that it is ensured that only the blade region 8 is coated during the coating operation.

The invention claimed is:

1. A mounting arrangement for mounting a turbine blade in a spray coating apparatus, comprising:

a first wall having a first wall first edge and a first wall second edge where the first wall second edge is arranged opposite the first wall first edge;

a second wall arranged opposite the first wall having a second wall first edge and a second wall second edge where the second wall first edge is in-line with the first wall first edge and the second wall second edge is in-line with the first wall second edge;

a third wall arranged between the first and second walls spanning between first wall first edge and the second wall first edge;

a fourth wall opposite the third wall arranged between the first and second walls spanning between first wall second edge and the second wall second edge;

a bottom portion spanning a lower edge of the first, second, third and fourth walls to form a five-sided box-like structure;

a cavity defined by an inner portion of the box-like structure having a rim arranged at an opening of the cavity that receives the turbine blade such that a root region of the turbine blade surrounded by the cavity and a blade region of the turbine blade protrudes away from the cavity opening wherein a gap is formed between the rim of the cavity opening and a portion of the blade region that adjoins the blade;

a plastic shielding layer arranged between the rim of the cavity opening and the portion of the blade region that adjoins the blade root where the plastic shielding material is resistant to the spray coating; and clamping members to allow for retaining of the shielding layer to a given wall within the cavity;

wherein the shielding layer includes a shielding plate arranged in the gap between the blade and the rim of the cavity opening and the shielding layer is applied such that the shielding layer projects beyond the shielding plate.

2. The mounting arrangement as claimed in claim 1, wherein the shielding is completely formed by the shielding layer.

3. The mounting arrangement as claimed in claim 1, wherein the shielding layer is formed by a plurality of shielding plates.

4. The mounting arrangement as claimed in claim 3, wherein the shielding layer includes a flexible shielding tape.

5. The mounting arrangement as claimed in claim 4, wherein the shielding tape is attached to the shielding plates.

6. The mounting as claimed in claim 1, wherein the shielding layer is a sprayed coating applied to the shielding plate.

7. The mounting as claimed in claim 6, wherein the sprayed coating is an adhesive resistant plastic.

8. The mounting as claimed in claim 7, wherein the plastic is PTFE.

9. The mounting as claimed claim 8, wherein the shielding is attached to the cavity of the box-like structure.

10. The mounting as claimed in claim 9, wherein the shielding extends from the cavity opening.

* * * * *